US006598768B2

(12) United States Patent
Celli

(10) Patent No.: US 6,598,768 B2
(45) Date of Patent: Jul. 29, 2003

(54) HEAD FOR KEGS OF PRESSURIZED DRINKS

(75) Inventor: Goffredo Celli, Coriano (IT)

(73) Assignee: Celli S.p.A., Coriano (IT)

( * ) Notice: Subject to any disclaimer, the term of this patent is extended or adjusted under 35 U.S.C. 154(b) by 0 days.

(21) Appl. No.: 09/921,793

(22) Filed: Aug. 6, 2001

(65) Prior Publication Data

US 2002/0050498 A1 May 2, 2002

(30) Foreign Application Priority Data

Oct. 31, 2000 (IT) ..... RN20000018 U

(51) Int. Cl.[7] ..... B65D 83/14
(52) U.S. Cl. ..... 222/400.7; 222/509; 137/322
(58) Field of Search ..... 222/399, 400.7, 222/400.8, 509; 137/212, 322

(56) References Cited

U.S. PATENT DOCUMENTS 5,176,298 A * 1/1993 Mogler et al. ..... 222/400.7
5,511,692 A * 4/1996 Willingham ..... 222/1
6,315,172 B1 * 11/2001 Till ..... 222/400.7

* cited by examiner

*Primary Examiner*—Kevin Shaver
*Assistant Examiner*—Stephanie Willatt
(74) *Attorney, Agent, or Firm*—Browdy and Neimark, P.L.L.C.

(57) ABSTRACT

A head for kegs of pressurized drinks comprises: a body, provided with means for coupling to a keg containing a drink; a piston movable between a first lowered position for opening a shutter of the keg and a second raised closure position; a lever for actuating the fork hinged on a stem thereof, subject to elastic means tending to make it rotate in the direction opposite that of actuation, to allow the stabilization of the operating fork in the first and in the second position of the piston; the actuating lever and the stem defining in combination a handle for the operating fork, the stem of the fork and the actuating lever being characteristically formed in such a way that, at least bilaterally to the handle, in correspondence at least with the lower segment of the handle where the first three fingers of the hand that sustains the handle act, there are no openings with variable port during the actuation of the lever.

7 Claims, 3 Drawing Sheets

HEAD FOR KEGS OF PRESSURIZED DRINKS

BACKGROUND OF THE INVENTION

The present invention relates to a head for kegs of pressurized drinks.

In the field of drinks distribution from dispensing systems provided with dispensers, the drinks to be distributed, generally carbonated, are contained in pressurized kegs. Such kegs must be connected, on one side, to the drinks dispenser and, on the other, to a line of pressurized gaseous carbon dioxide. Carbon dioxide, pressing on the free surface of liquid, causes the liquid to exit from a suction system towards a line connecting to the dispenser.

To obtain this dual connection of the keg to the carbon dioxide line and to the dispenser, heads are used which are connected, by means of various types of couplings (for instance, sliding, triangular or bayonet), to the upper face of the keg in correspondence with a shutter. In general the body of the headers for kegs of pressurized drinks has an inlet for a line conveying pressurized carbon dioxide, which is connected in a vertical guide of a tubular member. Internally to the tubular member is obtained a duct for the passage of the liquid contained in the keg. The upper end of the tubular member is external to the guide and bears a rubber-holder or an attachment for the line conveying the drink to the dispenser. With the head connected to the keg, when the tubular member is raised, its lower end remains distanced from the shutter, which stays shut. When the tubular member is lowered, its lower end opens the shutter of the keg and is connected to the suction system, whilst, simultaneously, the carbon dioxide can enter the keg, exert its pressure on the free surface of the liquid and thrust the drink outwards. The tubular member is actuated by means of an operating fork positioned astride the tubular member and hinged to the end of its two tines on the body of the head at the opposite side of the tubular member relative to the stem of the fork. The operating fork can be rotated in the plane of lay of the tubular member, acting manually on the stem. Geometric interference means between the fork and the tubular member determine the motion of the tubular member according to the motion of the fork itself. The operating fork can be locked in one of its extreme positions (corresponding to the two extreme positions of the tubular member for opening and closing the shutter), or released to move the tubular member.

Heads for kegs of pressurized drinks are known in which a knob, inserted coaxially on the stem, is operatively connected to a pin that is partially internal and coaxial to the stem. The pin projects towards the tines of the fork. On the body of the head, in correspondence with the two extreme positions of the operating fork, two seats for the insertion of the pin are obtained. Pulling the knob along the axis of the stem, therefore, it is possible to disengage the pin from the first (or from the second) seat and move the fork to the second (or to the first) seat. Elastic contrast means cause the pin to engage in this latter second (or first) seat, locking the operating fork again.

The heads described above have some drawbacks.

The operation is awkward, because, in order to overcome the force of the elastic contrast means and disengage the pin, the knob must be moved away from the body of the head along the axis of the stem of the operating fork. Moreover, between the knob and the pin, mechanical backlashes are present (or easily emerge with use) that can make imprecise the operation of the device.

Also known are heads for kegs of pressurized drinks, in which the stem of the operating fork is constituted by a substantially rectilinear box element, whose cross section is shaped substantially as an inverse "U". In the stem, in correspondence with the body of the head, is partially inserted and hinged an end of an operating lever, which is also box-like, substantially rectilinear and with a length comparable to that of the stem, having "U" shaped cross section opposite that of the stem. The lever and the stem are kept mutually diverging by elastic contrast means and define, in proximity to the hinge, a mortise for the insertion of a tenon integral with the body of the head. At rest, the distance between stem and lever progressively grows moving away from the body of the head.

When the lever is set down on the tenon, the operating fork is rotated upwards, the tubular member is raised and the shutter is closed. When the tenon is inserted in the mortise, the operating fork is rotated downwards, thetubular member is lowered and the shutter is open. To move from one position to the other, the operating lever has to be disengaged from the tenon. This can be done by simultaneously gripping and mutually approaching the stem and the operating lever in opposition against the action of the elastic contrast means.

Although it allows for a better grip and a more agile maneuver, this type of heads for kegs of pressurized drinks, however, is also not free of drawbacks.

During the motion of the lever relative to the stem, which is necessary to operate the fork and hence the tubular member, the palm of the operator's hand and his/her fingers are exposed to the free edges of the box elements constituting the lever and the stem where the lever at least partially telescopes into the stem thereby giving rise to scissors, with the consequent risks of cuts or wounds to the operator.

SUMMARY OF THE INVENTION

The aim of the present invention is to overcome the aforesaid drawbacks, making available a head for kegs of pressurized drinks which allows easily to open and close the shutter without any hazards of wounds or cuts to the operator's hands.

Another aim of the present invention is to make available a head for kegs of pressurized drinks that is ergonomic and convenient to use.

These aims and others beside, which shall become more readily apparent from the description that follows, are achieved, in accordance with the present invention, by a head for kegs of pressurized drinks as described in the accompanying claims.

BRIEF DESCRIPTION OF THE DRAWINGS

The invention is disclosed in greater detail hereafter with the aid of the drawings, which show an embodiment provided purely by way of non limiting example.

DESCRIPTION OF THE PREFERRED EMBODIMENTS

Figure 2:
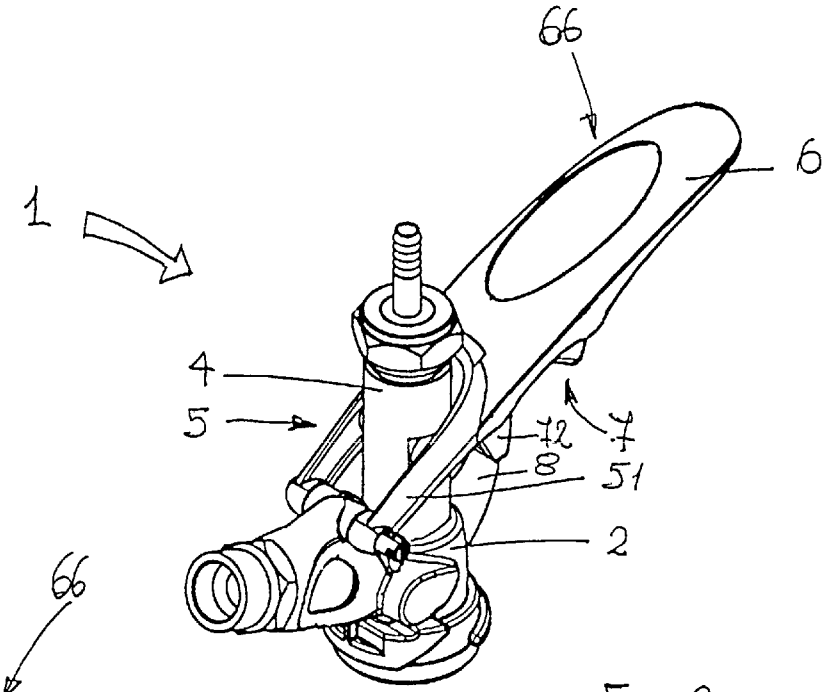
FIGS. 1 and 2 show a perspective schematic view of a head of the invention respectively with the tubular member in the position for opening and closing the shutter.
Figure 1:
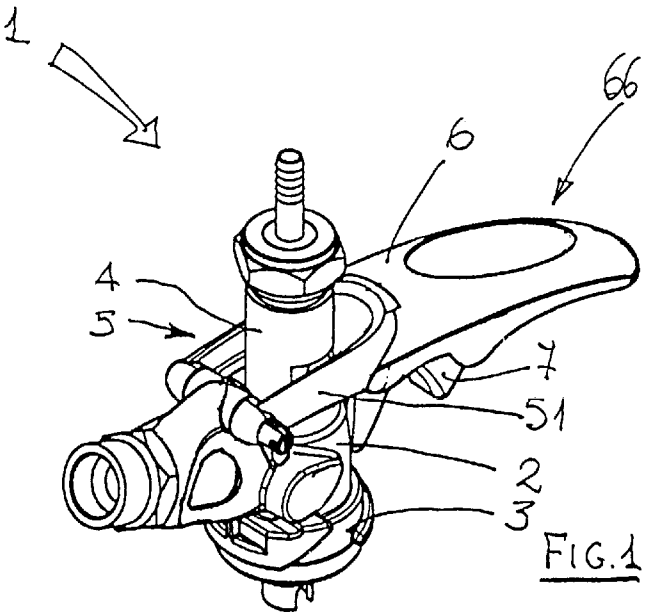
Figure 3:
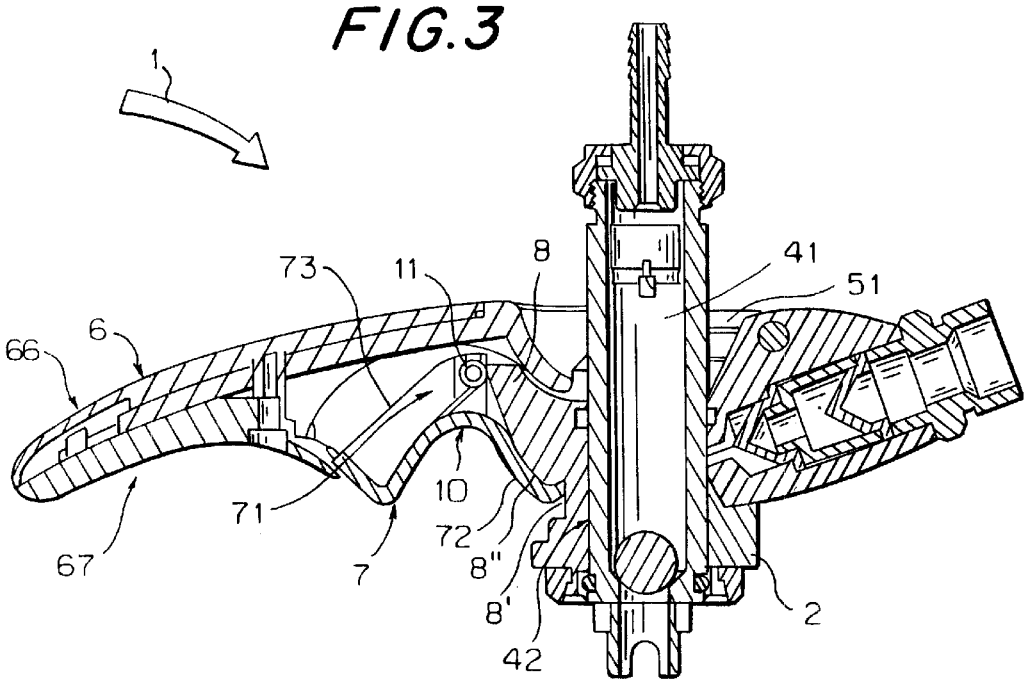
FIGS. 3 and 4 show median vertical section views corresponding respectively to FIGS. 1 and 2.
Figure 4:
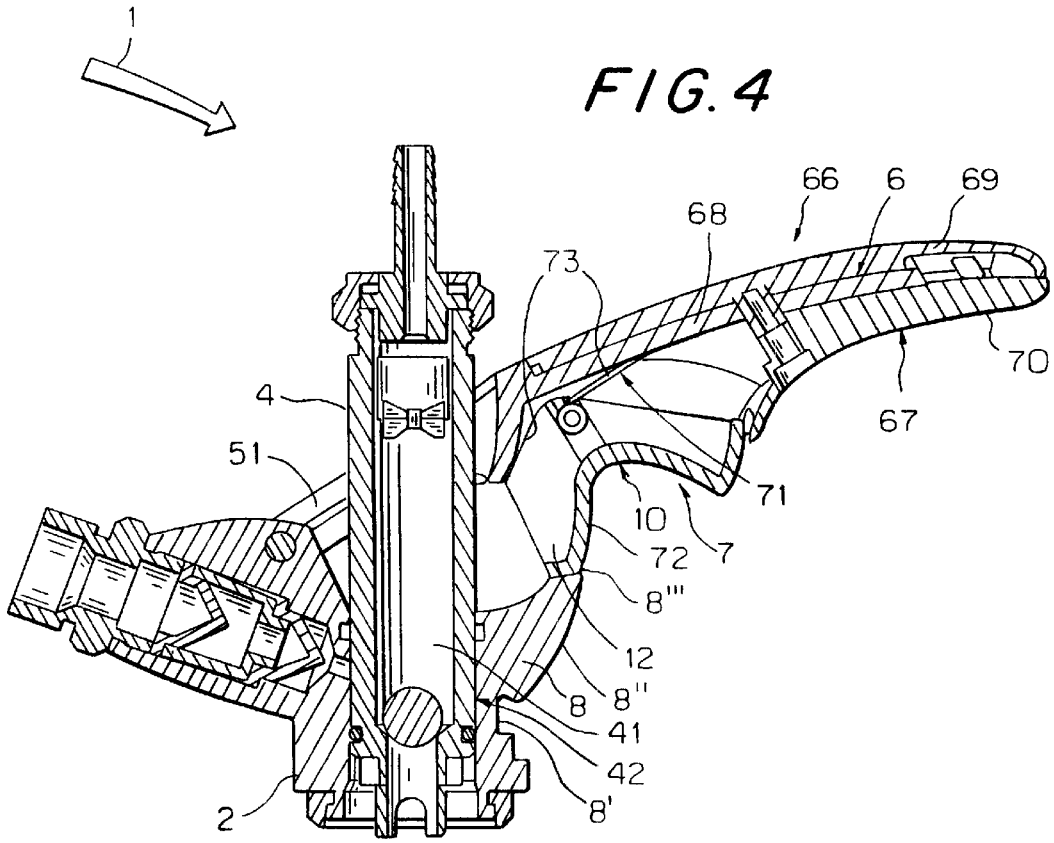
Figure 5:
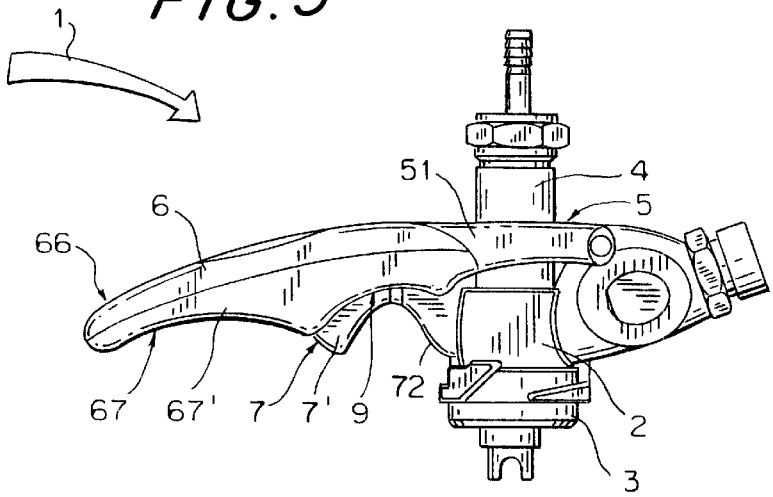
FIGS. 5 and 6 show lateral views corresponding respectively to FIGS. 1 and 2.
Figure 7:
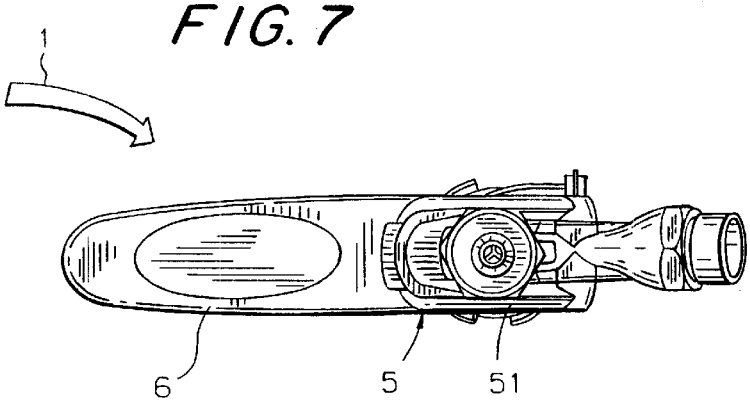
FIG. 7 shows a plan view of the subject invention shown in FIG. 5.
Figure 6:
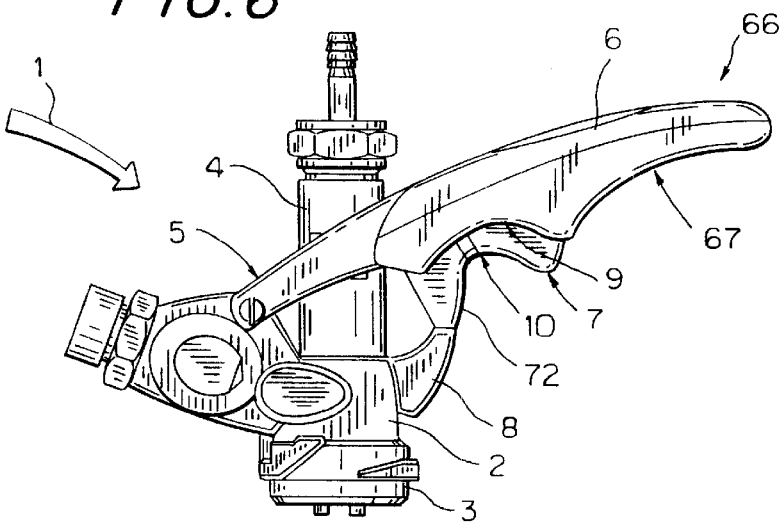

With reference to the figures, the number 1 indicates a head for kegs of pressurized drinks of the type. comprising a body 2, provided with means 3 for coupling to a keg (not shown) containing a drink. Said means can be constituted by a triangular, sliding or (as shown in the figures) bayonet coupling, depending on the type of attachment present on the keg. A tubular member 4 is provided with an internal duct for the passage of the drink contained in the keg and is movable, coaxially to a guide 42 obtained in the body 2, between a first lowered position, as shown in FIG. 3, for opening a shutter of the keg and a second raised position, as shown in FIG. 4, for closing the shutter. A fork 5 for actuating the tubular member 4 between the first and the second position is positioned astride of the tubular member 4 itself and pivotally engaged, at the end of its two tines 51, on the body 2 of the head 1 at the opposite side of the tubular member 4 relative to a stem 6 of the fork 5. Geometric interference means between the fork 5 and the tubular member 4 cause the tubular member 4 to move according to the motion of the fork 5.

The operating fork 5 can be locked in one of its two extreme positions (corresponding to the two extreme position of the tubular member 4 for the opening and closing of the shutter), or freed to move the tubular member 4. Fork 5 is moved between its first locked position to the second locked position by rotating fork 5 upward while pushing lever 7 to rotate around hinge 11 against elastic means 71 so as to disengage end 72 of the lever 7 from locked engagement in the bottom slot 8' of the fixed abutment 8 and permit its slidable engagement against the front 8" of the fixed abutment 8 until it reaches the locked engagement against the top 8"' of fixed abutment 8. This movement is reversed by rotating fork 5 downward while pushing lever 7 until end 72 disengages from top 8"' and slidably engages the front 8" until it is stopped in locked engagement in bottom slot 8'.

The operating lever 7 and the stem 6 define in combination a handle 66 for the operating fork 5 and, characteristically, are shaped in such a way that, at least bilaterally to the handle 66, in correspondence at least with the lower segment 67 of the handle 66 where the first three fingers of the hand that sustain the handle 66 act. Handle 66 and lever 7 are rotatably engaged together so that there are no gaps or openings between overlapping side walls 67' of lower segment 67 and side walls 7' of lever 7 when lever 7 is pushed into handle 66. The operator's hand, therefore, is always protected.

In an embodiment of the invention, free upper edges 73 of the lever 7 constantly remain, during its actuation, inside the volume of the stem 6, in correspondence with a cavity 9 complementary to the contour of the lever 7. In this way, the operator's hand is not exposed to hazardous free edges such as edges 73 acting like the blades of a pair of scissors.

Advantageously, moreover, at least the lower segment 67 of the grip 66, where the first three fingers of the hand that sustain the handle 66 act, is contoured to comfortly engage these fingers. The grip and manipulation of the operating fork 5, therefore, is greatly facilitated and wholly safe.

Conveniently, in a preferred embodiment of the invention, the stem 6, in correspondence at least with the lower segment 67 of the handle 66 where the first three fingers of the hand that sustain the handle 66 act, has closed conformation and the lever 7 is reduced to a simple trigger 10, which can be operated with the index finger of the hand.

In addition, advantageously, the stem 6, in addition to being inferiorly shaped in anatomical fashion, blends with the trigger 10, which in turn is shaped to naturally engage the index finger.

Advantageously, moreover, the trigger 10 has, anteriorly to its rotating hinge 11, a hollow projection 12, to lock in stable but removable fashion the tubular member 4 in the first position by inserting the fixed abutment 8 inside it, as well as to lock in stable but removable fashion the tubular member 4 in the second position by contrast setting on the fixed abutment 8.

Advantageously, as shown in FIGS. 3 and 4, the stem 6 comprises a core 68 and two outer shells 69, 70, removably fastened to each other and to the core 6. The outer shells 69 and 70 can be made of plastic material.

The operation of the invention is as follows. Once the head 1 is coupled to the keg, it is connected to a line for conveying carbon dioxide (not shown) and to a conduit for feeding a dispenser (not shown). The fork 5 is rotated upwards, with the tubular member 4 stably maintained in the second position (raised, for closing the shutter of the keg) by engagement of the end 72 of the lever 7 against the fixed abutment 8 (in particular, for instance, by the setting of the hollow projection 12 against the fixed abutment 8). Gripping the handle 66 and pulling the lever 7 towards the stem 6 in opposition against the action of the elastic means 71 (in particular, for instance, by pulling the trigger 10), the operating fork 5 is disengaged and can be made to rotate in such a way as to bring the tubular member to the first position for opening the shutter. At this point, the end 72 is slidably engaged over the fixed abutment 8 (in particular, for instance, by means of the insertion of the fixed abutment 8 inside the hollow projection 12 due to the reaction of the elastic means 71) locks the tubular member 4 in the first position. The closing of the keg is achieved with the inverse movements.

The invention achieves important advantages.

First of all, the ease of operation determined by the presence of the lever 7 is combined with the complete protection of the operator's hand from scissors-like movements of the parts of the device, thereby eliminating cutting or wounding hazards.

In the second place, a configuration is obtained with a high degree of ergonomics and gripping ease.

The invention thus conceived can be subject to numerous modifications and variations, without thereby departing from the scope of the inventive concept that characterizes it.

Moreover, all components can be replaced by technically equivalent elements.

In practice all materials employed, as well as dimensions, may be any, depending on requirements.

What is claimed is:

1. A head for kegs of pressurized drinks comprising:

a body having means for engaging a keg containing a pressurized drink, a guide and a fixed abutment;

a tubular member having an inner duct to permit passage of the pressurized drink, the tubular member being movable in the guide in the body between a first lowered position for opening a shutter of the keg and a second raised position for closing the shutter;

a fork for the tubular member between the first position and the second raised position having a pair of tines and a stem, the tines engaged astride the tubular member and rotatably engaged at respective free ends to the body at an opposite side of the tubular body relative to the stem;

a lever rotatably engaged on the stem against elastic means which locks the fork on the fixed abutment in both the first position and the second position and releases the fork from the fixed abutment for movement between the first position and the second position when actuated:

wherein first walls on the stem overlap and slidably engage second walls on the lever so that free edges on the second walls remain entirely within a cavity within the stem so as to eliminate any gap between the first walls and the second walls which may change in size where fingers of a user would grip the stem and lever.

2. A head as claimed in claim 1, wherein the stem is closed with a lower segment to form a handle where the fingers of the user that sustain the handle act, the lever being formed as a trigger rotated into the cavity of the handle which can be operated with the index finger of the hand, wherein no gap is produced between the trigger and stem when the trigger is rotated.

3. A head as claimed in claim 2, wherein the stem blends with the trigger so as to provide a shape to accommodate an index finger of the user.

4. A head as claimed in claim 2, wherein the trigger has a hollow projection which locks the tubular member in the first position after the fixed abutment has been inserted in an interior of the hollow projection or locks the tubular member in the second position when the hollow projection is moved to engage a top of the fixed abutment.

5. A head as claimed in claim 2, wherein the stem comprises a core and two outer shells, removably fastened to each other and to the core.

6. A head as claimed in claim 3, wherein the stem comprises a core and two outer shells, removably fastened to each other and to the core.

7. A head as claimed in claim 4, wherein the stem comprises a core and two outer shells, removably fastened to each other and to the core.

* * * * *